United States Patent [19]

Akeret

[11] 4,208,897

[45] Jun. 24, 1980

[54] PROCESS AND EQUIPMENT FOR THE COMMERCIAL INDIRECT EXTRUSION OF LONG LENGTHS OF METAL, IN PARTICULAR LONG AS-CAST BILLETS INTO SECTIONS OR THE LIKE

[75] Inventor: Rudolf Akeret, Löhningen, Switzerland

[73] Assignee: Swiss Aluminium Ltd., Chippis, Switzerland

[21] Appl. No.: 913,798

[22] Filed: Jun. 8, 1978

[30] Foreign Application Priority Data

Jul. 12, 1977 [CH] Switzerland ..... 8568/77

[51] Int. Cl.[2] ..... B21C 23/32; B21C 27/00; B21C 33/00; B21C 35/04

[52] U.S. Cl. ..... 72/253 R; 72/254; 72/263; 72/270; 72/272

[58] Field of Search ..... 72/253–255, 72/263, 270, 272, 273, 60, DIG. 31

[56] References Cited

U.S. PATENT DOCUMENTS

| | | | |
|---|---|---|---|
| 3,520,164 | 7/1970 | Pennell et al. | 72/270 |
| 3,526,119 | 9/1970 | Wassen | 72/264 |
| 3,538,730 | 11/1970 | Alexander et al. | 72/60 |
| 3,563,080 | 2/1971 | Alexander et al. | 72/272 |
| 3,577,759 | 5/1971 | Tandler et al. | 72/254 |
| 3,736,786 | 6/1973 | Wagner | 72/255 |
| 4,010,046 | 3/1977 | Setzer et al. | 148/11.5 A |
| 4,106,320 | 8/1978 | Pardoe | 72/256 |

FOREIGN PATENT DOCUMENTS

| | | | |
|---|---|---|---|
| 40-26411 | of 1965 | Japan | 72/273 |
| 43-5216 | of 1968 | Japan | 72/270 |
| 49-5827 | of 1974 | Japan | 72/270 |
| 435402 | 9/1935 | United Kingdom | 72/253 A |

*Primary Examiner*—Carl E. Hall
*Assistant Examiner*—D. M. Gurley
*Attorney, Agent, or Firm*—Bachman and LaPointe

[57] ABSTRACT

A process and device allows long as-cast billets to be extruded, with the help of a container which is divided into at least two segments which can be opened and closed radially with respect to the main axis. In the closed position, the segments grip the part of the billet inside the container and, as a result of a relative movement between a die mounted on a hollow stem, the said die is forced into a length of the billet inside the container as a result of which at least one section is extruded. On opening the segments, the billet is advanced to fill the container again whereupon the segments close, clamping onto the billet, and the extrusion sequence is repeated.

24 Claims, 10 Drawing Figures

PROCESS AND EQUIPMENT FOR THE COMMERCIAL INDIRECT EXTRUSION OF LONG LENGTHS OF METAL, IN PARTICULAR LONG AS-CAST BILLETS INTO SECTIONS OR THE LIKE

BACKGROUND OF THE INVENTION

The invention concerns a process and equipment for the commercial indirect extrusion of long, essentially straight lengths of metal, in particular long as-cast billets, into sections or the like using a split container which clamps onto the billet when in the closed position and into which a shaping die mounted on a hollow extrusion stem is forced.

A process which is known to be used for the production of sections from billets which are considerably longer than the container involves continuously pushing the billet into the shaping die which closes off the container at one end. The force to overcome the friction in the container and the force for the shaping process itself must be produced by a feeding device and must be transmitted by the part of the billet which is still outside the undivided container. This part of the billet is unsupported at the sides which results in the disadvantage that there is a relatively low upper limit to the extrusion ratio which can be employed. The extrusion ratio can be increased if the material in the container immediately in front of the die is heated. Since this heating, however, depends on the thermal conductivities of the container wall and the billet material, it determines the upper limit of the extrusion rate.

Hydrostatic extrusion is another method known for the commercial extrusion of long billets through a cylindrical container. In this case the cylindrical container is closed off at one end by a shaping die, and a liquid introduced into the container surrounding the billet on all sides before extruding the billet under pressure from all sides. There are however many disadvantages associated with this process, e.g., the temperature of extrusion is limited because of the danger of decomposing the compression fluid, and so for any given extrusion ratio greater extrusion force is required. Furthermore, the storage of elastic energy in the compression fluid and the resultant tendency for the extrusion to emerge in a series of jerks makes it necessary to use seals which can withstand fluids under high pressure; the internal diameter of the container has to be larger in order to accommodate the compression fluid and billets with particularly clean surface have to be chosen.

SUMMARY OF THE INVENTION

The object of the present invention is, with the above mentioned disadvantages in mind, to find a solution whereby only the part of the billet onto which the container clamps is used to transmit the force of extrusion, with the result that extrusion can be carried out only by the indirect extrusion method.

The advantages of indirect extrusion of ingots which have been cut to length are well known. In addition to these, there are other advantages to be gained in using billets of almost unlimited length viz., the shearing off and removal of the ingot butt after each extrusion sequence is eliminated, on extruding with a skin it is not necessary to remove the skin in a separate step, instead the process can be arranged so that the removal of the skin from the container is associated with the advancement of the billet, a step which is necessary anyway. Consequently, the non-productive time and the amount of scrap is considerably reduced. Also, products can be produced in the required length without extrusion weld seams or additional operations and in weights which almost correspond to the weight of the billet, a feature which is of advantage, for example, in the production of wire.

These advantages make the process suitable for the manufacture of products which have good clean surfaces and a uniform structure, and at the same time achieving high extrusion rates and short idle times, i.e., high throughput efficiency.

BRIEF DESCRIPTION OF THE DRAWINGS

The following schematic drawings are presented to explain in greater details the process and equipment necessary to carry out the process of the invention. Directions of movement are indicated in the drawings by arrows, wherein.

DETAILED DESCRIPTION OF THE PREFERRED EMBODIMENTS

Figure 1:
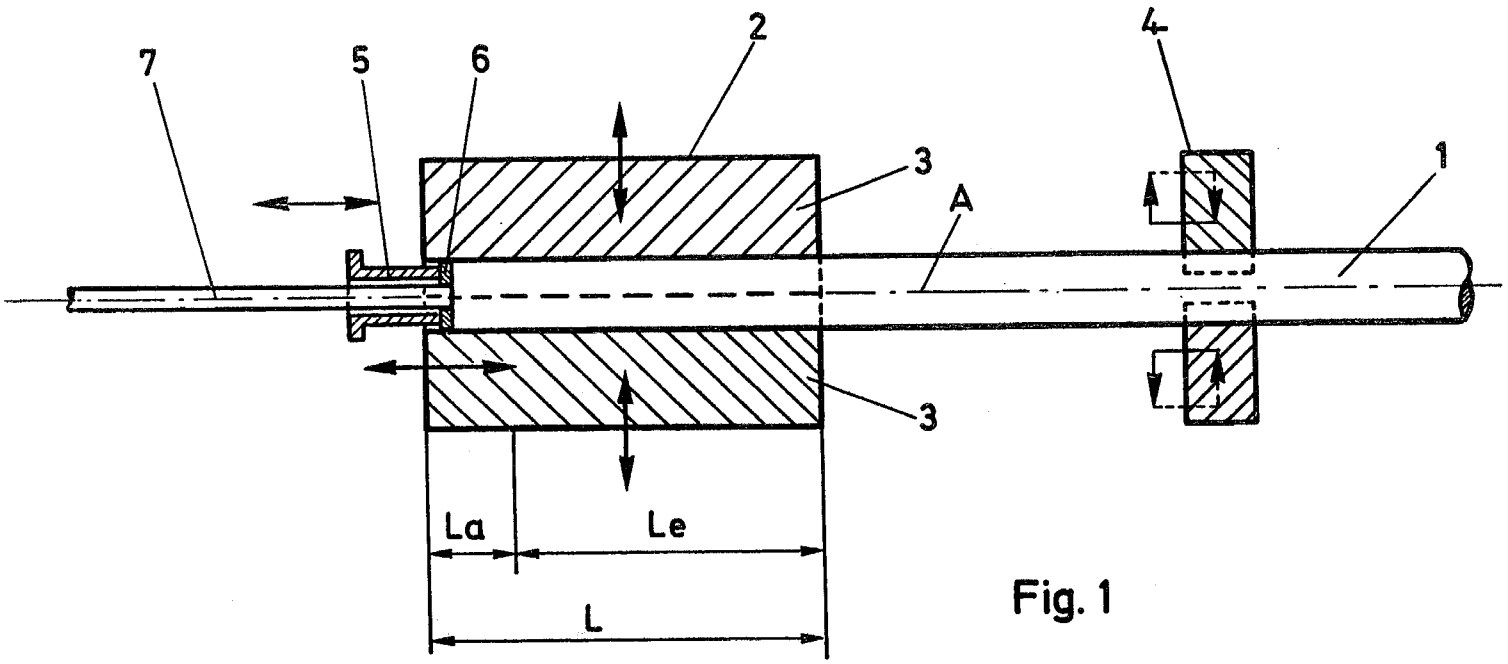
FIG. 1: Principle of the process.

The process of the invention characterizes the industrial extrusion of the length (La) of a billet which cannot be bent and is of any desired length, whereby the billet is preferably an as-cast ingot and such that the billet passes in a straight line through a container (2) which is divided along its length parallel to the central axis (A) to form segments (3), which can be opened and closed radially by suitable means and, on opening the container (2) the billet (1) is pushed into it in the axial direction from the end remote from the extrusion die, filling the container (2) along its whole length (L) by the front part of the billet (1).

By closing up the container segments (3) the front part of the billet of length (Le) is engaged under a clamping force by the container segments (3) and by virtue of the friction between the billet (1) and the segments (3) there results an axial force which is at least equal to the extrusion force produced by forcing a hollow stem (5) with die (6) mounted on it into the front part of the container (2).

The penetration of the billet (1) by the die (6) mounted on a hollow stem takes place by means of a relative movement between the die (6) and the container (2) along the direction of the central axis and results in at least one section (7) being extruded.

After extruding the section (7), the segments (3) of the container (2) are opened again and a relative movement between the die (6) and the container (2) brings them back to their starting positions; at the same time the billet (1) is pushed further into the container (2) by a length (La) by means of a feeding device (4). The container (2) is therefore full again and, after closing the segments (3), a new extrusion sequence can begin.

In a preferred version (FIG. 2) the relative movement between the die (6) and the container (2) is achieved by means of a movable die (6) and a container which cannot move along its central axis. In this case the container is held by a stationary frame (8).

In another preferred version (FIG. 3) the relative movement is achieved by means of a die (6) which cannot move parallel to its central axis and a container (2) which can be moved in the direction of its central axis. In this case the hollow stem (5) which bears the die (6) is immovable and is mounted securely in a stationary frame (10).

The billets can be heated in whole, complete lengths in separate furnaces, before being introduced into the container (2) at the extrusion temperature. Annealing the billets separately, in particular in the case of as-cast billets of aluminum alloys that are difficult to extrude, has the advantage that it can include a homogenization anneal at the same time. A homogenization anneal has an advantageous effect on extrudability of the billet, and on the structure and surface quality of the extruded product.

Figure 2:
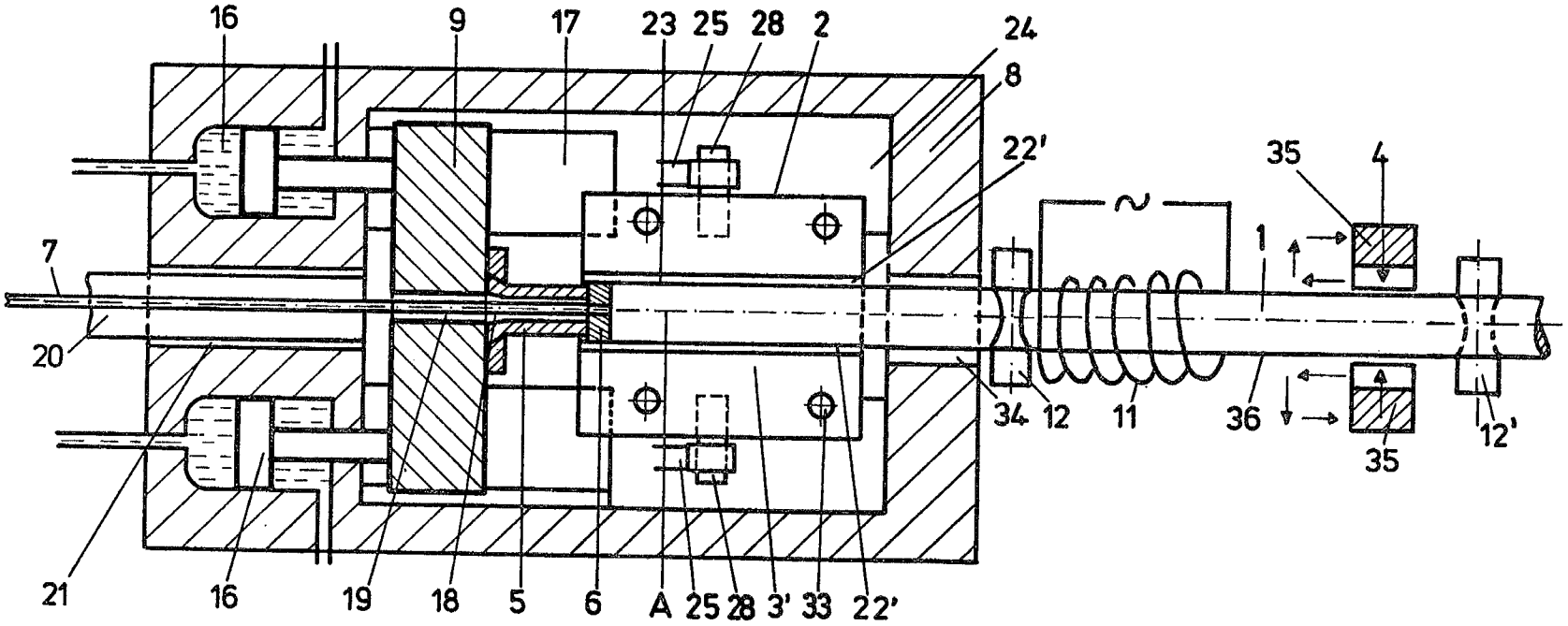
FIG. 2: Extrusion equipment with extrusion die which is pushed inside the container, which is unable to move in the direction of extrusion.

In the version according to FIG. 2 the billet (1) is heated shortly before entering the container (2) over a short length corresponding approximately to the length (La) to be extruded, the heating being carried out by means of conventional equipment (11). Heating to the extrusion temperature in this manner has the advantage that the conventional guide rolls (12) which exert no force are not subjected to thermal loading and optimum control of the temperature can be achieved.

Furthermore, in this case billets which have been homogenized and cooled at different rates can be employed.

Provision may readily be made for the possibility of loading a number of billets one after the other.

For reasons of safety there may be a delay time between the previously mentioned sequence of movements so that the filling of the container (2) with the billet (1) can take place only after the segments (3) of the container (2) have been opened, and the die (6) can enter the container (2) and the billet (1) only after the segments (3) have been closed.

The force applied by the feeding device (4) is small compared with the force of extrusion. The force applied to advance the billet can therefore be maintained at least partially throughout the process, being particularly advantageous when the billet (1) is passed rapidly through the container (2).

Another feature of the process of the invention is that the outer diameter of the die can be smaller than the inner diameter of the closed container so that as the die penetrates the container and the billet, the skin (13) of the billet is sheared off, whereby the extruded sections is provided with a particularly clean surface.

In order that the pipe-shaped outer skin (13) can be easily freed from the inner face of the segments which are designed mainly to provide good frictional contact with the billet, the surface of the billet can be coated with a suitable releasing agent.

Figure 10:
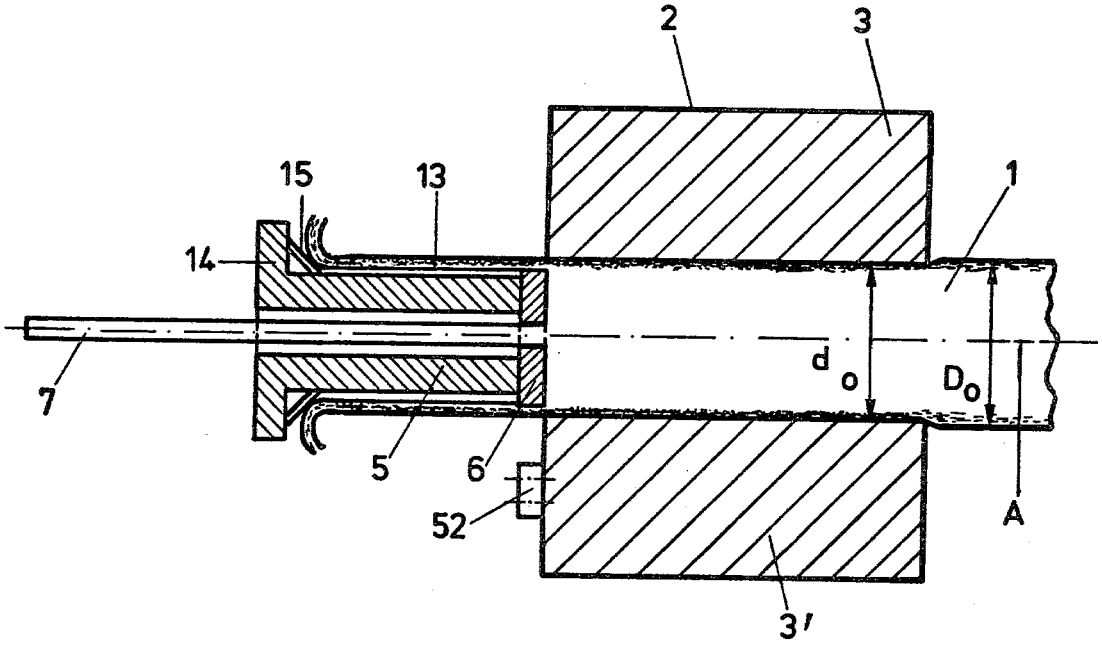
FIG. 10: Extruding and removing the outer skin of the as-cast ingot.

The outer skin can be removed by advancing the billet and cutting or shearing it off after it is outside the container (2) as shown in FIG. 10.

It has been found particularly advantageous that in the following thrust of the die into the container, the pipe-shaped skin (13) formed by the previous extrusion step can be split into at least three parts by means of knives (15) at the base (14) of the hollow stem (5), see FIG. 10, these parts of the skin being easy to remove at the end of at least two extrusion sequences.

Another feature of the invention is that the length of billet which can be extruded in a single thrust, and thus the length of section produced, can be very readily adjusted to suit different requirements. The process is suitable not only for extrusion of long shapes which are starting material for further drawing operations and require large units of metal, but also for sections which normally have to be cut to lengths of 5–7 m for transportation.

Under the conditions that the above mentioned frictional force must be greater than the extrusion force, and that there is an upper limit to clamping force acting radially on the surface of the billet via the container segments producing the said friction, it can be shown that the ratio of the length (Le) of the part of the billet (1) not extruded to the inner diameter ($d_o$) of the closed container (2) must be approximately equal to five. The length (La) of billet extruded is chosen such that the resistance of the hollow stem to buckling is not exceeded.

The billets extruded are mainly 50–200 mm in diameter. One version of equipment for carrying out the process of the invention is shown in horizontal section through the main axis (A) in FIG. 2. A platen (9), which is pushed by pistons (16) and moves on bearing blocks (17), is fitted with a hollow stem (5) carrying a die (6) at the end and, in the stage shown in FIG. 2, moves towards a closed container (2) which cannot move in the direction of the axis (A). In FIG. 2 the die has in fact already penetrated part of the billet (1). The resultant sections (7) pass through an opening (18) in the stem (5) and an opening (19) in the platen (9) and leave the extrusion press via a run out table (20) part of which is situated in an exit opening (21) in the frame (8).

Figure 5:
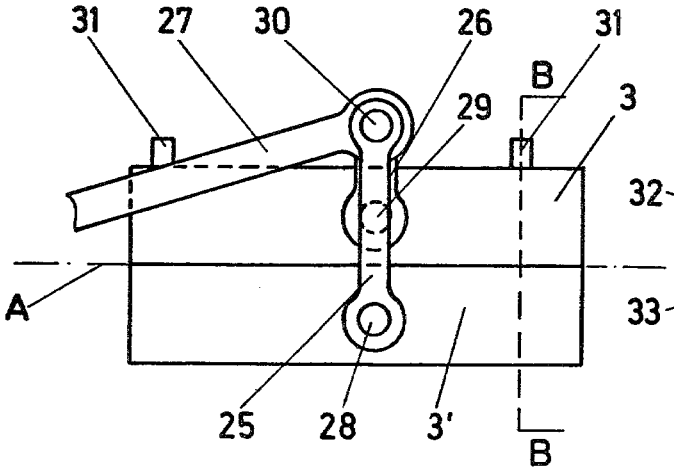
FIG. 5: Closed container shown in FIG. 2.

In the embodiment shown in FIG. 2 the container comprises two segments (3, 3') which have wear resistant, friction-promoting liners (22, 22') the inner faces (23) of which clamp onto the billet (1). The segments (3, 3') can be heated by means of facilities not shown in the drawing. The lower segment (3') is immovable and is connected to a base (24) which in turn is secured to the stationary frame (8). The upper segment (3) can be moved in the vertical direction by means of a toggle joint mechanism comprising at least three rods (25, 26, 27) which pivot about at least three shafts (28, 29, 30); this mechanism can be made operate by pistons not shown here. In the clamping step the shafts (28, 29, 30) effect closure of the container (2) by means of a jointed lever action (FIG. 5). The shaft (28) is permanently connected to the lower segment (3'), the shaft (29) is permanently secured to the upper segment (3) and the shaft (30) provides the connection between the rods (25, 26 and 27).

Additional guidance of the upper segment (3) during raising and lowering is provided by four rods (31) which pass through holes (32) in the upper segment (3) and are screwed into threaded holes (33) in the lower segment (3').

Figure 4:
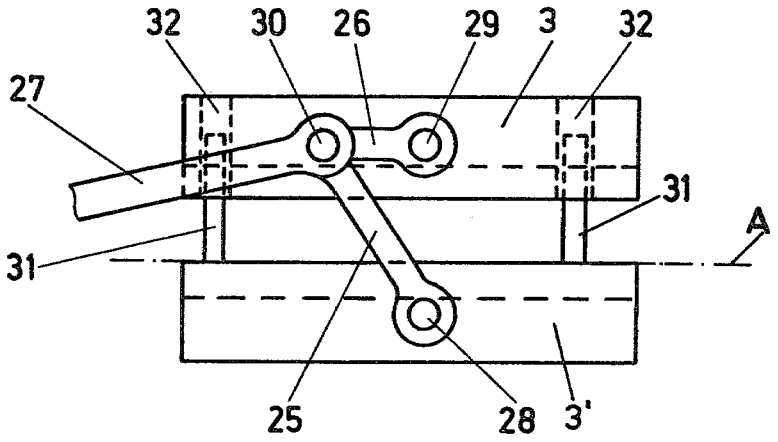
FIG. 4: Open container of FIG. 2 with clamping device.

As soon as the segments are open, as in FIG. 4, the billet (1) is pushed through the opening (34) in the frame (8) by means of a feed device (4) with two gripping blocks (35) and advanced by a length corresponding to the previously extruded length (La) so that the container (2) is full again. At the same time the pistons (16) bring the platen (9) into the starting position again. The gripping blocks (35) which are positioned symmetrically with respect to the billet (1) and the main axis (A) are moved towards the surface (36) of the billet by means of the mechanism operating the feed device (not shown here) until the billet is firmly held and, after the subsequent reloading sequence, the grips release the billet and move back to the starting position as indicated by the arrows. To prevent the billet from tilting out of line during the feeding operation guide rolls (12) are provided with suitable spacing between them and are profiled in such a way that roll (12) engage part of the upper half of the billet and rolls (12') engage part of the lower half of the billet.

The process is however not limited to the version described above. The movable segment (3) can also be fitted with conventional pistons (hydraulic pistons, spindles) with or without toggle-joint closure. Also, both segments (3, 3') can be made movable as the movement needed to raise the segments (3, 3') from the billet surface (36) need amount to only a few millimeters.

Figure 6:
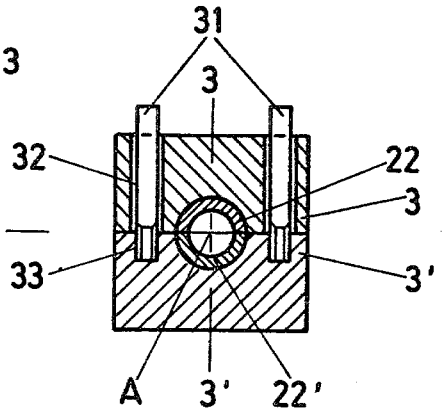
FIG. 6: Section through the container shown in FIG. 5 along line B—B.
Figure 7:
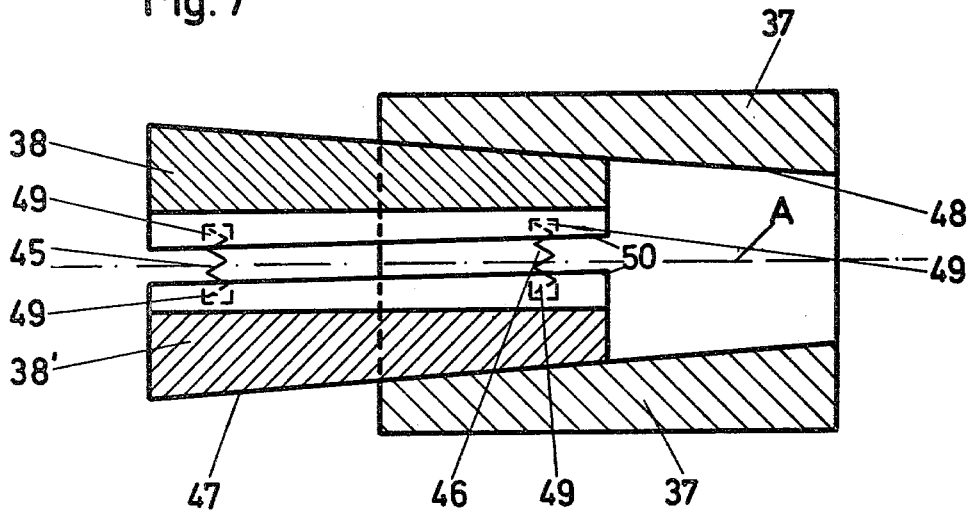
FIG. 7: Open container of FIG. 3.
Figure 8:
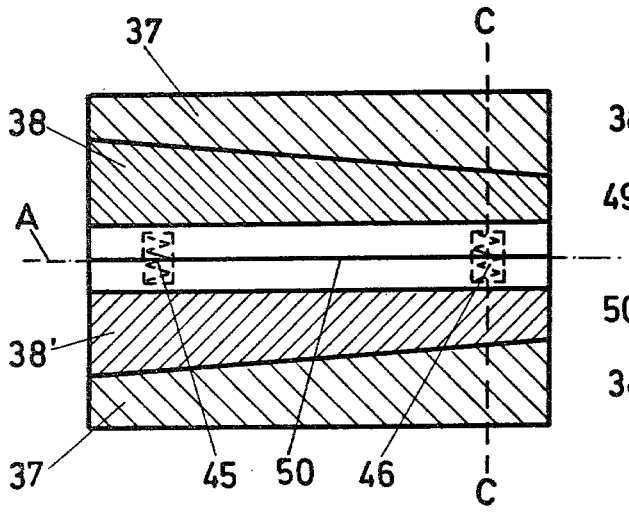
FIG. 8: Closed container of FIG. 3.
Figure 9:
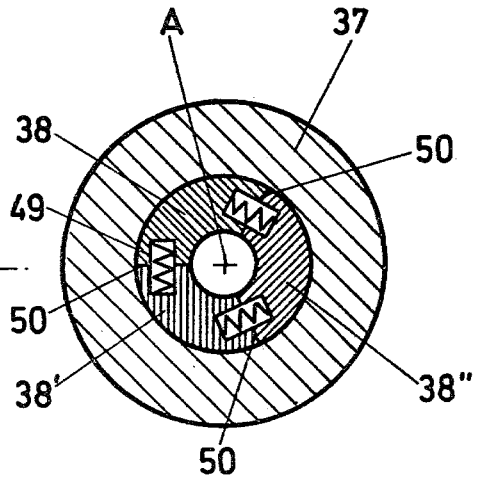
FIG. 9: Section through the container shown in FIG. 8 along line C—C.

A container can, however, also be made movable as shown in FIGS. 4–6, and in the case of a container as shown in FIGS. 7–9 the outer part of the container can be secured to the frame of the equipment; the changes this requires in the arrangement of the main and auxiliary rams are obvious.

Figure 3:
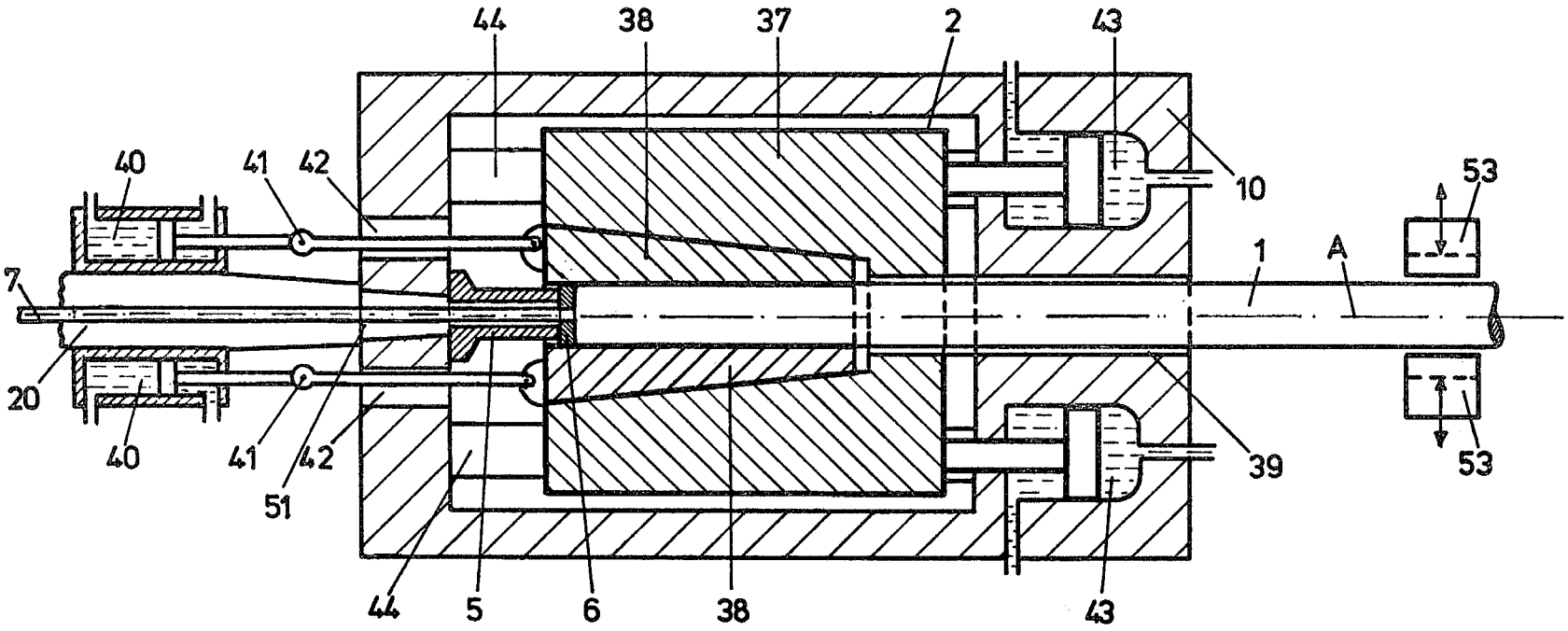
FIG. 3: Extrusion equipment with an extrusion die which cannot move in the direction of extrusion and a movable container around it.

The equipment in FIG. 3 shows a cylindrical container (2) with an outer part (37) which has a conical hole in it and into which three segments (38, 38', 38'') can slide and wedge onto the billet (1) when in the closed position (FIGS. 8, 9). The outer part (37) and the segments (38, 38',38'') can be heated by a facility which is not shown here. The billet (1) enters the open container (FIG. 7) via an opening (39) in the stationary frame (10) by means of guide rolls which are not shown here and, after the segments have been closed the part (La) of the billet (1) is extruded into one or more sections (7) by the container, together with the billet onto which it is clamped, being pushed onto a die fitted on the end of a hollow stem (5) which is immovable, being securely fixed to the stationary frame. The outer part (37) of the container is guided by fixed rails (44) and is pushed forwards by the rams (43) at the billet entry end of the frame (10). The grips (53) at the input end of the billet are open during extrusion. At the end of the extrusion sequence they are closed whereupon they hold the billet (1) securely in place while the rams (43) move the outer part (37) of the container by a length (La) in the direction opposite to that of the feed of the billet, and at the same time the segments (38) are moved in the extrusion direction by the auxiliary rams facility (40) and a jointed rod assembly (41) which passes through openings (42) in the frame (10), so that the segments (38) can be opened and release the billet (1). On opening the segments their outer faces (47) are pushed apart by the compressed springs (45, 46) and pressed against the conical inner faces (48) of the outer part (37). The springs (45, 46) are set into holes (49) which are arranged symmetrical to the flat dividing faces (50) of the segments (38) and also to the axis (A). Also symmetrical to this axis (A) are the cross section of the billet (1), the outer part (37) of the container, the segments (38), the hollow stem (5) and the parts (not shown) for providing straight alignment of the billet into the container (2). Symmetrical to a plane running vertically through the axis (A) are the entry opening (39), the exit opening (51) in the stationary frame (10) out of which the extruded sections (7) emerge and are conveyed further with the help of a conventional run-out table (20), and the bearing blocks (44) to guide the outer part (37) of the container (2).

Even as the outer part (37) is moving back the distance (La) to the starting position, the segment (38) previously raised from the billet can move into the outer part (37), again by reversing its direction, to engage a new part of the billet.

After the grips (53) have been relaxed from the billet (1) by means of a device (not shown here) a new extrusion sequence can begin.

The invention is however not limited to the above exemplified embodiment; instead of the auxiliary rams (40) fly wheels with rods connected to the segments (38) can move the segments backwards and forwards, and the backwards and forwards movement of the outer part of the container can also be achieved via a rotation with respect to the axis (A) by means of a suitable drive mechanism. Another possibility is that the container (2) shown in FIGS. 7–9 can be built into equipment of the kind shown in FIG. 3 with the entry and exit ends changed around so that the segments (3) wedge the billet (1) in the direction of extrusion, with the result that the ram members (43) have to grip the segments and the auxiliary rams (40) the outer part of the container.

The outer part (37) which is conical inside and cylindrical outside can be enclosed in at least one cylindrical sleeve which effectively counteracts the pressure inside on the conical face when the said sleeve is shrunk onto the outer part (37).

FIG. 10 illustrates more clearly the procedure by which a tubular outer skin is sheared off the billet by the penetration of the die which has a smaller diameter than that ($d_o$) of the closed container. The container is made up of two segments (3 and 3') which press in on the billet (1) thus reducing its diameter ($D_o$) to a size ($d_o$). This reduction in billet diameter is only very slight. At the start of the second and all subsequent extrusion sequences the tubular shaped skin (13) which has been sheared away from the outer part of the billet (1), is slit by a relative movement between the hollow stem (14) and the closed container by means of a knife edges mounted at the base end of the hollow stem as the die penetrates the billet along a distance (La). Stops (52) provided on the segments prevent the knives (15) from coming into contact with the closed container.

These stops (52) can also be mounted on a movable platen or a stationary frame.

Calculating the length (Le) which has to be clamped and the necessary clamping force ($P_k$) should give a general impression of the dimensioning of the equipment:

The relation between $P_R$ (the friction force between the billet (1) and the closed segments (3) of the container) and the force $P_M$ acting on the die (6) must be as follows:

$$P_R \geqq P_M \qquad (I)$$

Where $P_M = p_M \cdot A_o$ and $p_M$ is the average pressure acting on the whole of the die face $A_o$ with the result:

$$P_M = p_M \cdot \frac{d_o^2 \pi}{4} \quad \text{(II)}$$

($d_o$=diameter of the die ≈ diameter of the closed segments (3) ). $k_f$ is the resistance of the billet material to deformation, and it has been found by experience that the value 10 $k_f$ represents the upper limit for the extrusion pressure $p_M$:

$$p_M(\text{Max}) = 10\ k_f \quad \text{(III)}$$

The area of contact between the segments (3) and the length (Le) of billet (1) onto which the segments press is $$\pi \cdot d_o \cdot Le \quad \text{(IV)}$$

When extruding without lubrication the predominating condition is one of complete adhesion for which the following assumptions can be made concerning the shear stress $\tau$ at the wall:

$$\tau \approx 0.5\ k_f \quad \text{(V)}$$

which can be used to calculate the force of friction $P_R$ as $$P_R = 0.5\ k_{fl} \cdot \pi \cdot d_o \cdot Le \quad \text{(VI)}$$

Substituting expressions (I)-(VI) in (I) gives the condition $$Le \approx 5\ d_o \quad \text{(VII)}$$

for the lower limit of length (Le) to be clamped in by the segments. The clamping facility must be able to exert a clamping force $P_k$ which is larger than that resulting from the radial pressure $p_R$ which the material to be extruded exerts on the inner surface of the container segments:

$$P_k \approx (Le + La) \cdot d_o \cdot p_R \quad \text{(VIII)}$$

During the time the newly advanced billet is held, the following is valid over the whole length:

$$p_R \approx k_f \quad \text{(IX)}$$

During extrusion, immediately behind the die the following applies:

$$p_R \approx p_M - k_f \leqq 9 \cdot k_f \quad \text{(X)}$$

At increasing distance away from the die, $P_R$ decreases as a result of the frictional contact. Averaged over the length (Le) being gripped, it may be assumed that:

$$p_R \leqq 5 \cdot k_f \quad \text{(XI)}$$

At a greater distance from the die the upper limit for the radial pressure may be assumed to be:

$$P_R \sim k_f \quad \text{(XII)}$$

It follows them with Le=5 and a length to be extruded which is limited by the resistance of the stem to buckling, which can for example be assumed to be $La = 5 \cdot d_o$ that:

$$P_k \sim 5\ d_o^2 \perp k_f + 5\ d_o^2 \cdot k_f \quad \text{(XIII)}$$

EXAMPLE

A cast billet of an aluminum alloy is at a temperature of 470° C. and has a resistance to deformation $k_f$ of approximately 3 kp/mm$^2$. The diameter ($d_o$) of the closed container is 150 mm.

The length (Le) required to be clamped by the container is 750 mm, the requisite clamping force ($P_K$) 2000 $M_P$ (as long as the extruded length (La) is not much more than five times the diameter of the closed container).

The clamping force in the first version (FIG. 2) is produced by a special facility acting on the segments (3 and 3'). In another version of the equipment (FIG. 3) the clamping force is transferred from the extrusion force itself, whereby the clamping force depends on the inclination of the conical inner face of the outer part (37) of the container (2) or the angle of inclination of the wedge shaped segments as viewed in a longitudinal cross section.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

I claim:

1. A process for the extrusion of billets into sections or the like with the help of a container and an extrusion die, which comprises:

dividing the container in contact with the billet to be extruded into at least two segments which can be opened and closed radially to the long axis (A) of the container and the billet wherein said container when closed clamps that part of the billet of length (La) to be extruded at least up to the die area;

providing on opening said segments a relative movement in the direction along said axis (A) between the billet and the container, as a result of which the container is filled by the billet essentially over its whole length (L);

producing after closing said segments a relative movement between a die mounted on a hollow stem and the closed container, whereby said die is forced into the billet inside the container so that said part of the billet of length (La) inside the container is extruded through the opening in the die thus forming at least one section;

transmitting a force which is at least equal to the force required to extrude said at least one section to the length (Le) of said billet inside the container not extruded by means of the friction between the inner wall of the closed container and the surface of the billet;

filling the container by applying a force which is small compared with the extrusion force and which is borne by a part of the billet projecting out of the container; and opening said segments at the end of an extrusion sequence, whereupon a relative movement between the container and the die returns them to their starting position and a relative movement between the container and the billet of distance (La) fills the container again, so that after closing said segments a new length (La) of said billet can be extruded.

2. A process according to claim 1 wherein during the relative movement between said container and said die, the container is stationary.

3. A process according to claim 2 wherein the container is held securely as it is filled in the direction along its main axis while the billet is moved in the extrusion direction by the grips of a feeding device which engages the part of the billet projecting out of the container.

4. A process according to claim 1 wherein during the relative movement between said container and said die, the die is stationary.

5. A process according to claim 4 wherein on filling said container the billet is held stationary and the container is moved in the direction counter to the extrusion direction, with the billet being held by gripping blocks at the part thereof projecting out the container.

6. A process according to claim 1 wherein the container is filled only when the segments of the container are completely open, and the penetration of the billet by the die begins only when the segments of the container are completely closed.

7. A process according to claim 1 wherein said force required to fill the container is at least in part continuously maintained.

8. A process according to claim 1 wherein the ratio of the length of billet not extruded (Le) to the inner diameter ($d_o$) of the closed container is not smaller than five.

9. A process according to claim 1 wherein the length of the part (La) of the billet extruded is about the same as the diameter ($d_o$) of the closed container.

10. A process according to claim 1 wherein the length of billet extruded can be set at a specific length.

11. A process according to claim 1 wherein the billet is heated over its whole length to the extrusion temperature in a separate furnace.

12. A process according to claim 1 wherein immediately before entering the container the billet is heated to the extrusion temperature over a length correspondingly approximately to the length of the part of the billet to be extruded.

13. A process according to claim 11 wherein the billet is previously subjected to a homogenization treatment.

14. A process according to claim 12 wherein the billet is previously subjected to a homogenization treatment.

15. A process according to claim 1 wherein the surface of the segment of the container coming into contact with the billet is given a pretreatment to promote frictional contact with the billet.

16. A process according to claim 1 wherein the billet is given a coating before being extruded.

17. A process according to claim 1 wherein on opening and closing the segments of the container a relative movement in the direction approximately parallel to said axis takes place between the outer part of said container and said segments.

18. A process according to claim 17 wherein the outer surface of said segments slide on a conical inner face of the outer part of said container, and on closing said segments wedge onto said billet.

19. A process according to claim 1 wherein the outer diameter of the die is smaller than the inner diameter ($d_o$) of the closed container and, as the die penetrates the billet, it shears off the outer skin of the billet.

20. A process according to claim 19 wherein on opening the segments of the container the sheared-off skin is freed from said segments moved on during the feeding movement together with the billet, and then removed completely.

21. A process according to claim 19 wherein the sheared-off outer skin of the billet is freed from said segments of the container as they are opened, then transported further on the billet during the extrusion of the billet, and finally removed completely.

22. A process according to claim 20 wherein at the start of a second extrusion sequence the sheared-off skin is slit into at least three parts with the aid of knives mounted at the base of said hollow stem.

23. A process according to claim 21 wherein at the start of a second extrusion sequence the sheared-off skin is slit into at least three parts with the aid of knives mounted at the base of said hollow stem.

24. A process according to claim 1 wherein a plurality of billets are fed for extrusion one after another.

* * * * *

UNITED STATES PATENT AND TRADEMARK OFFICE

CERTIFICATE OF CORRECTION

PATENT NO. : 4,208,897

DATED : June 24, 1980

INVENTOR(S) : Rudolf Akeret

It is certified that error appears in the above-identified patent and that said Letters Patent are hereby corrected as shown below:

Column 9, lines 38-39, claim 12, change "correspondingly" to read --corresponding--.

Signed and Sealed this

*Nineteenth* Day of *August 1980*

[SEAL]

*Attest:*

SIDNEY A. DIAMOND

*Attesting Officer*

*Commissioner of Patents and Trademarks*